United States Patent [19]

Bond et al.

[11] 4,124,437

[45] Nov. 7, 1978

[54] SYSTEM FOR ETCHING PATTERNS OF SMALL OPENINGS ON A CONTINUOUS STRIP OF METAL

[75] Inventors: Herbert M. Bond, St. Paul; Charles E. Ring, Minneapolis; John A. Edgar, St. Paul; Ronald Bennett, Minneapolis; Willis K. Paul, Bloomington; Roland N. Harshbarger, St. Paul, all of Minn.

[73] Assignee: Buckbee-Mears Company, St. Paul, Minn.

[21] Appl. No.: 673,598

[22] Filed: Apr. 5, 1976

[51] Int. Cl.[2] ..... C23F 1/02

[52] U.S. Cl. ..... 156/640; 156/345; 156/644; 156/661

[58] Field of Search ..... 156/8, 11, 18, 3, 345, 156/640, 644, 661, 664–666; 96/36.1, 36.4

[56] References Cited

U.S. PATENT DOCUMENTS

| | | | |
|---|---|---|---|
| 2,536,383 | 1/1951 | Mears et al. | 156/11 X |
| 3,082,774 | 3/1963 | Benton et al. | 156/345 X |
| 3,385,745 | 5/1968 | Mears | 156/345 |
| 3,415,699 | 12/1968 | Brown | 156/11 X |
| 3,679,500 | 7/1972 | Kubo et al. | 156/11 |
| 3,929,551 | 12/1975 | Frantzen | 156/640 X |
| 3,971,682 | 7/1976 | Frantzen | 156/11 |

*Primary Examiner*—William A. Powell

*Attorney, Agent, or Firm*—Jacobson and Johnson

[57] ABSTRACT

An etching system having a first member for unrolling and fastening a protective film on one side of a continuous strip of metal and a second member for smoothly stripping the protective film from the continuous strip of metal after the continuous strip of metal and the protective film have passed between sets of spray jets that are located on opposite sides of the continuous strip of metal. Further etching and rinsing stations are provided for completing the etching process to enable mass production of television aperture masks having a plurality of openings which have a dimension on the order of or less than the thickness of the mask material.

12 Claims, 7 Drawing Figures

SYSTEM FOR ETCHING PATTERNS OF SMALL OPENINGS ON A CONTINUOUS STRIP OF METAL

BACKGROUND OF THE INVENTION

1. Field of the Invention

This invention relates generally to etching systems and, more particularly, to an etching system and apparatus for controllably etching openings which have a minimum dimension that is on the order of or less than the thickness of the metal in which the opening is etched by use of a protective film which overlays a resist layer which is located on one surface of the continuous strip of metal and a plurality of etching stations which continuously spray etchant onto the continuously moving strip of metal.

2. Description of the Prior Art

In a typical television color tube, the shadow mask or aperture mask, as it is sometimes called, is located between the electron guns at the rear of the tube and phosphor coated faceplate at the front of the tube. Electron beams pass through the openings or apertures in the shadow mask and impinge upon a suitable color producing phosphor dot on the faceplate. Behind each of these openings in the shadow mask and on the faceplate are sets of three phosphor dots, a triad, one dot for each of the primary colors. Typically, around each of these dots is a black area which surrounds the various color phosphor dots. During the operation of the picture tube, the shadow mask openings or apertures act as a guide for the electron beams.

One of the problems in the manufacture of a television aperture mask is the difficulty in accurately manufacturing masks with the miniature or small openings therein. Recently, there has been a demand for a mask in which the opening is elongated with the width or the minimum dimension of the elongated openings being on the order of or less than the thickness of the material from which the mask is made. The problem of mass producing aperture masks having an opening with a dimension on the order of the thickness of the mask material is that to date it is difficult, if not impossible, to have a system and apparatus that will accurately and consistently etch openings which have a minimum dimension on the order of 0.007 inch to 0.002 inch when the base material is 0.006 inch to 0.009 inch. It has been found that the conventional mass production etching techniques, i.e., etching from both sides, are unacceptable because these techniques generally produce over-etching as well as irregular etching. The over-etching is produced by lateral etching of the base material that inherently accompanies etching perpendicular to the surface of the material. Consequently, the process of making apertures having a minimum dimension on the order of or less than the thickness of the material has to date been a difficult and time-consuming task as each aperture mask must be individually etched and checked to obtain a usable aperture mask.

Examples of technique for attempting to accurately etch an opening in very thin material are shown in the Kubo U.S. Pat. No. 3,679,500, assignees' prior art copending application U.S. Ser. No. 487,663 filed July 11, 1974 by Frantzen, Barton and Ring for "Etching Process for Accurately Making Small Holes in Thick Materials," and German Offenlengungsschrift Pat. No. 3,432,602 which shows the use of a roll of film. While all these prior art processes are useful teachings, the main problem of having a system that consistently and accurately etches small openings in a continuous strip of moving metal, remains as a difficult but desirable goal from both a quality and economic standpoint.

The present invention comprises an advancement to the art by disclosing an apparatus having metal web handling machines, a film applying machine which securely applies a protective layer over a moving metal web so that the web can be directed through a plurality of etching stations in which the etchant is sprayed on both sides of the metal web even though a protective film is located on one side of the metal web.

DESCRIPTION OF THE PREFERRED EMBODIMENT

Figure 1A:
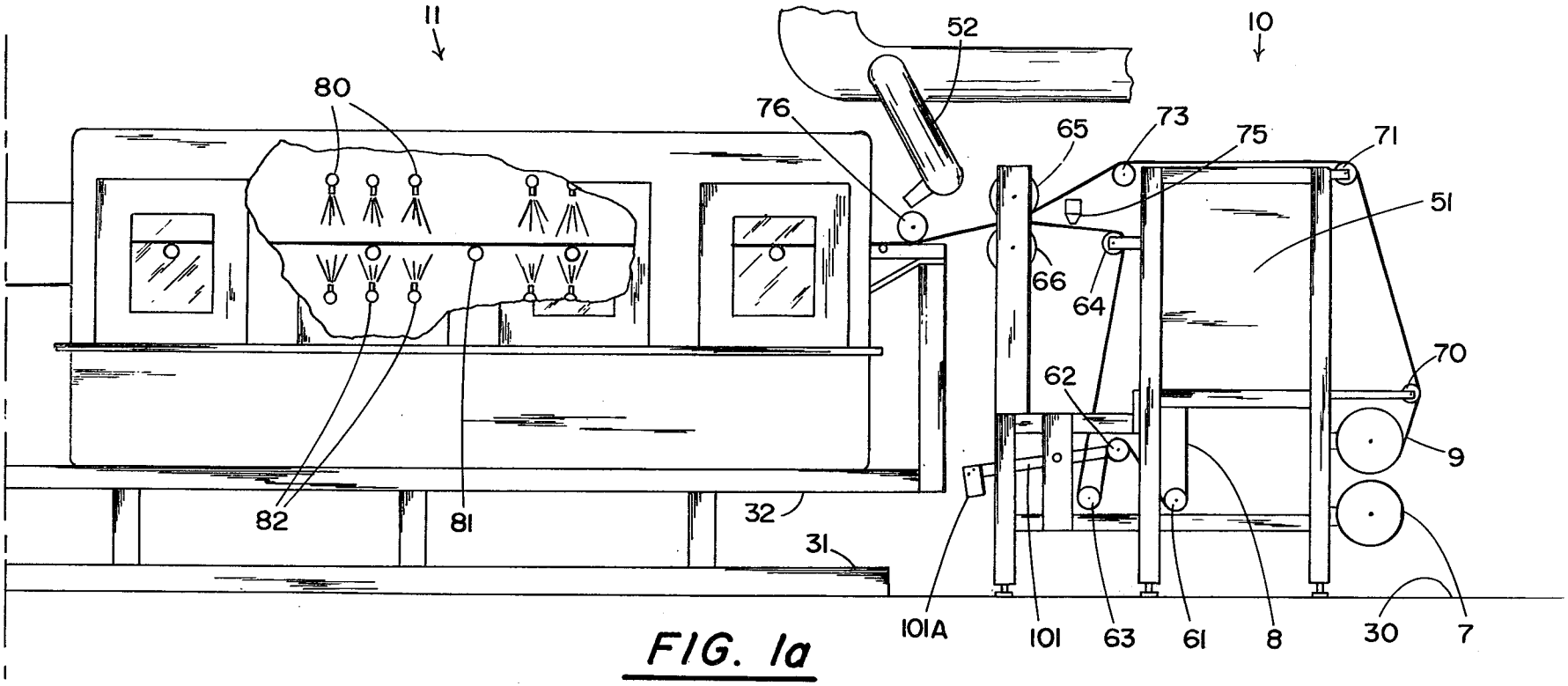
FIGS. 1A, 1B, 1C, 1D, 1E and 1F, when placed end to end, show a system for taking a resist covered metal web and performing the necessary handling, protecting and etching operations to produce a highly accurate etched aperture mask.
Figure 1B:
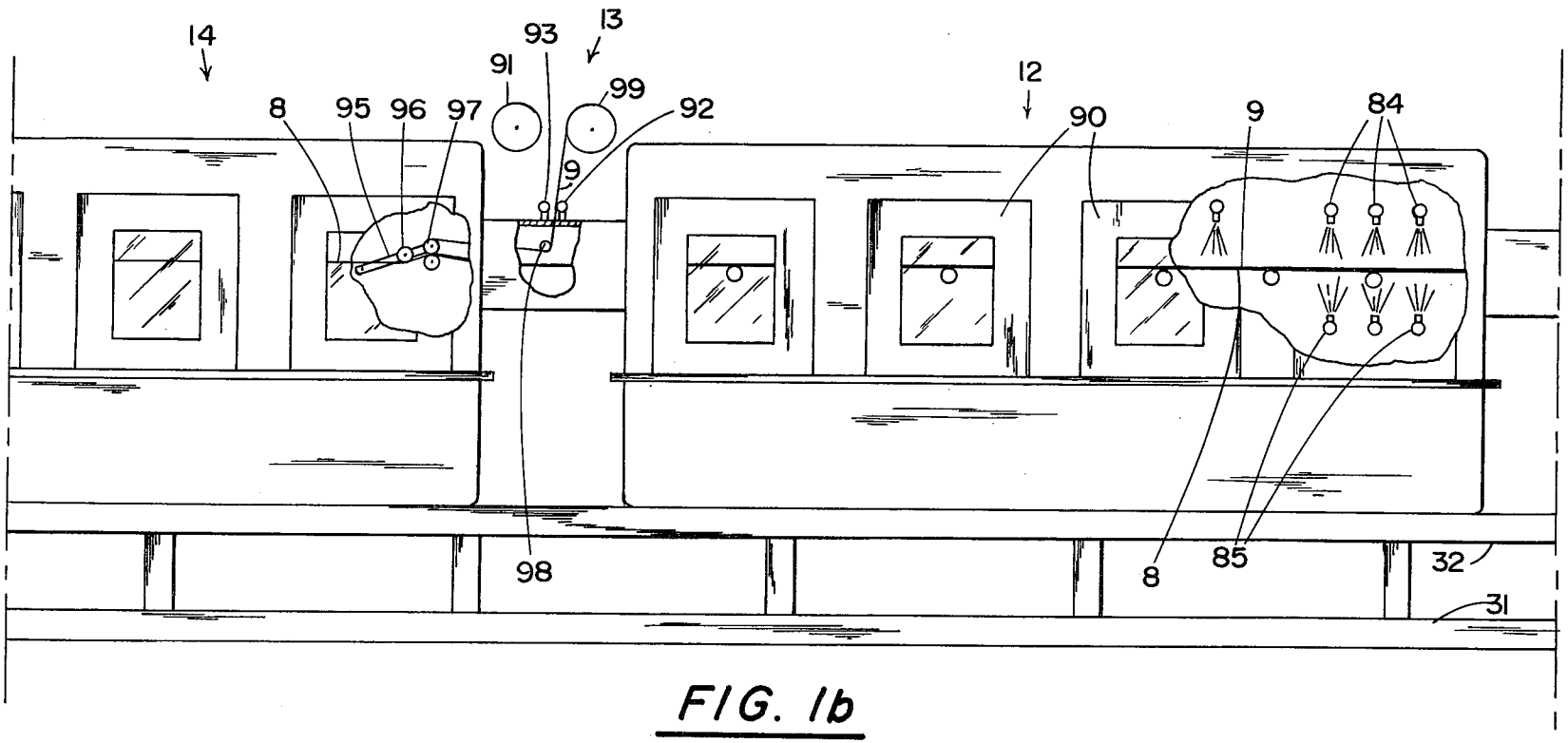
Figure 1C:
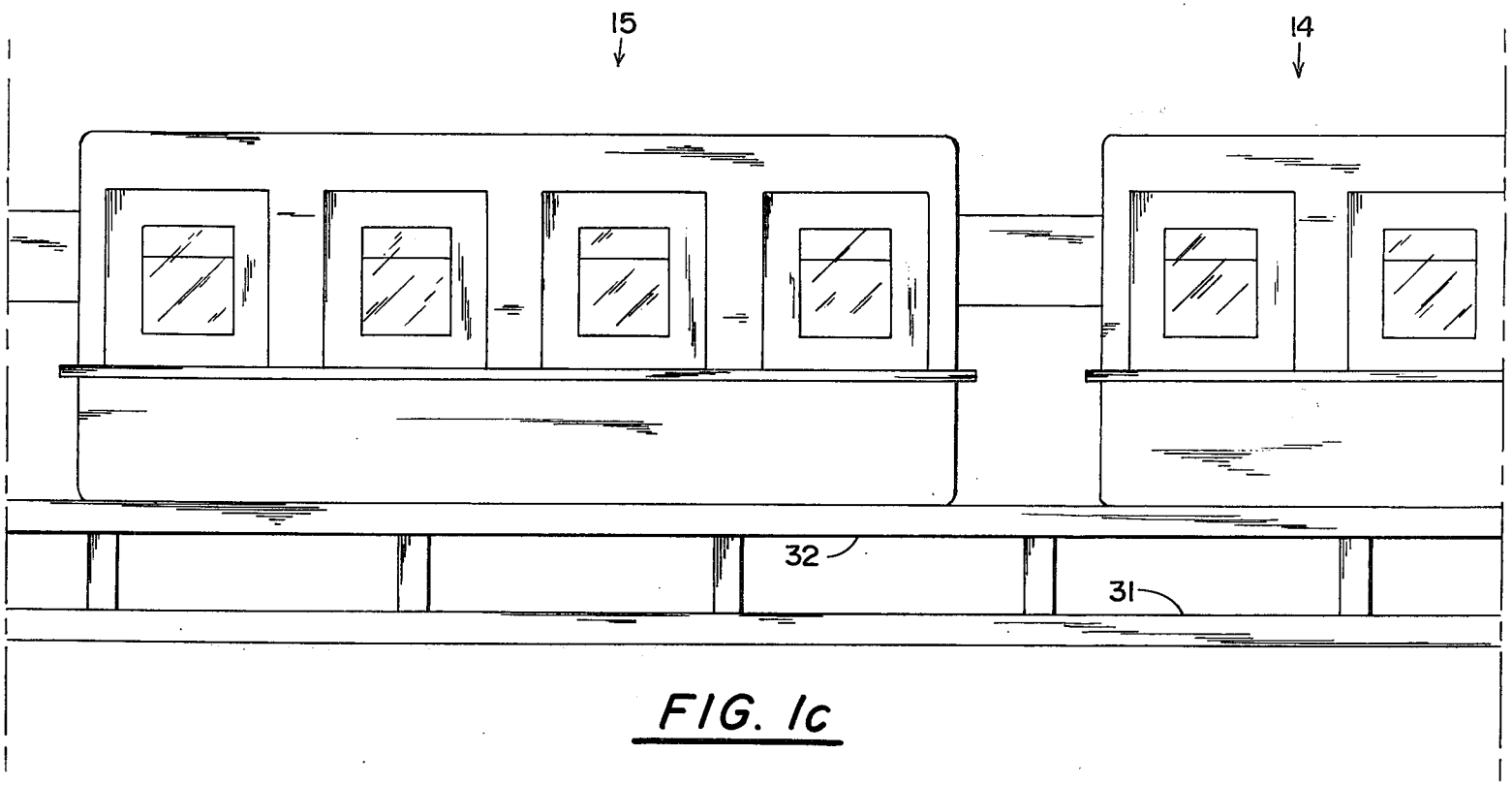
Figure 1D:
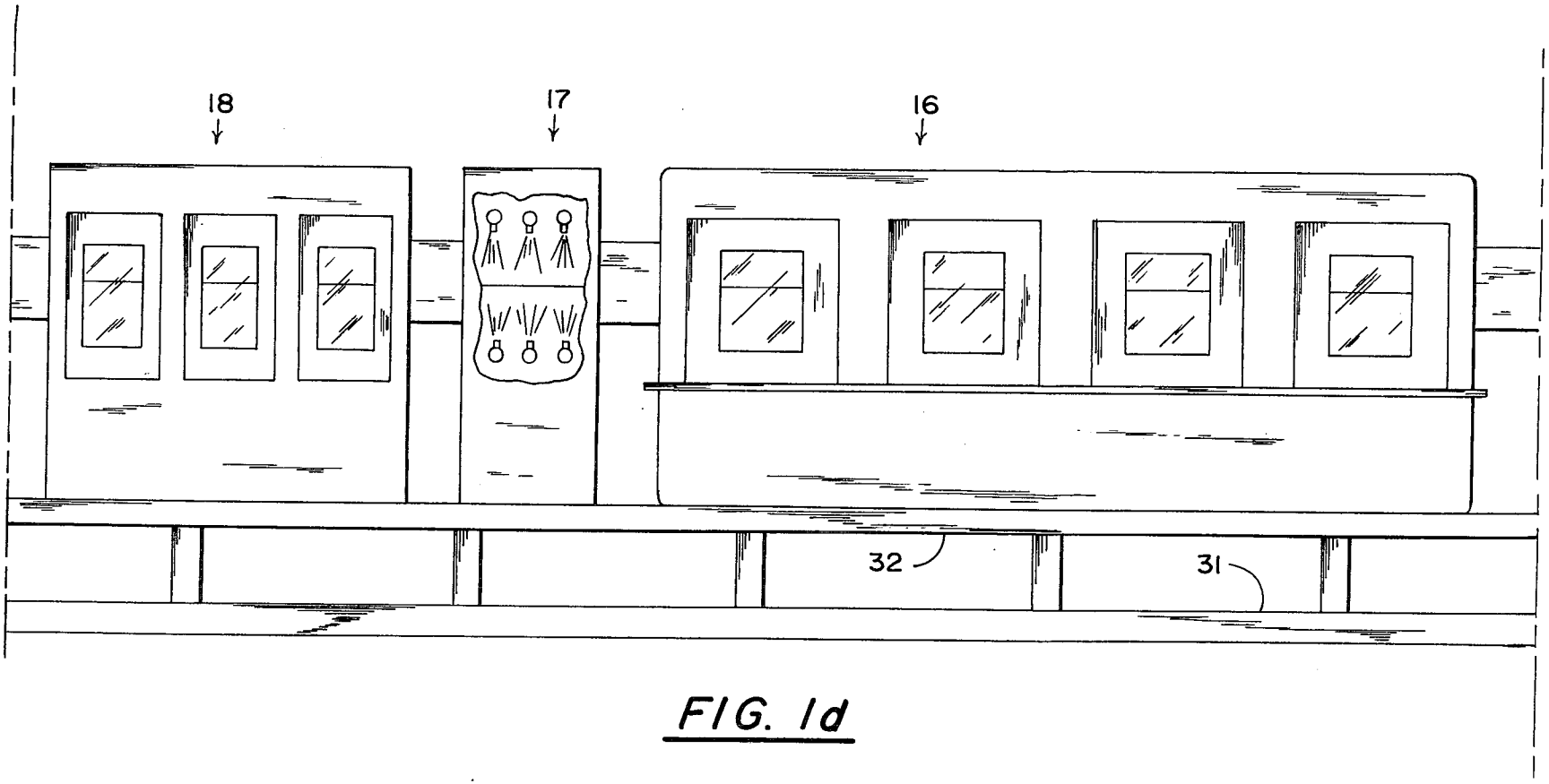
Figure 1E:
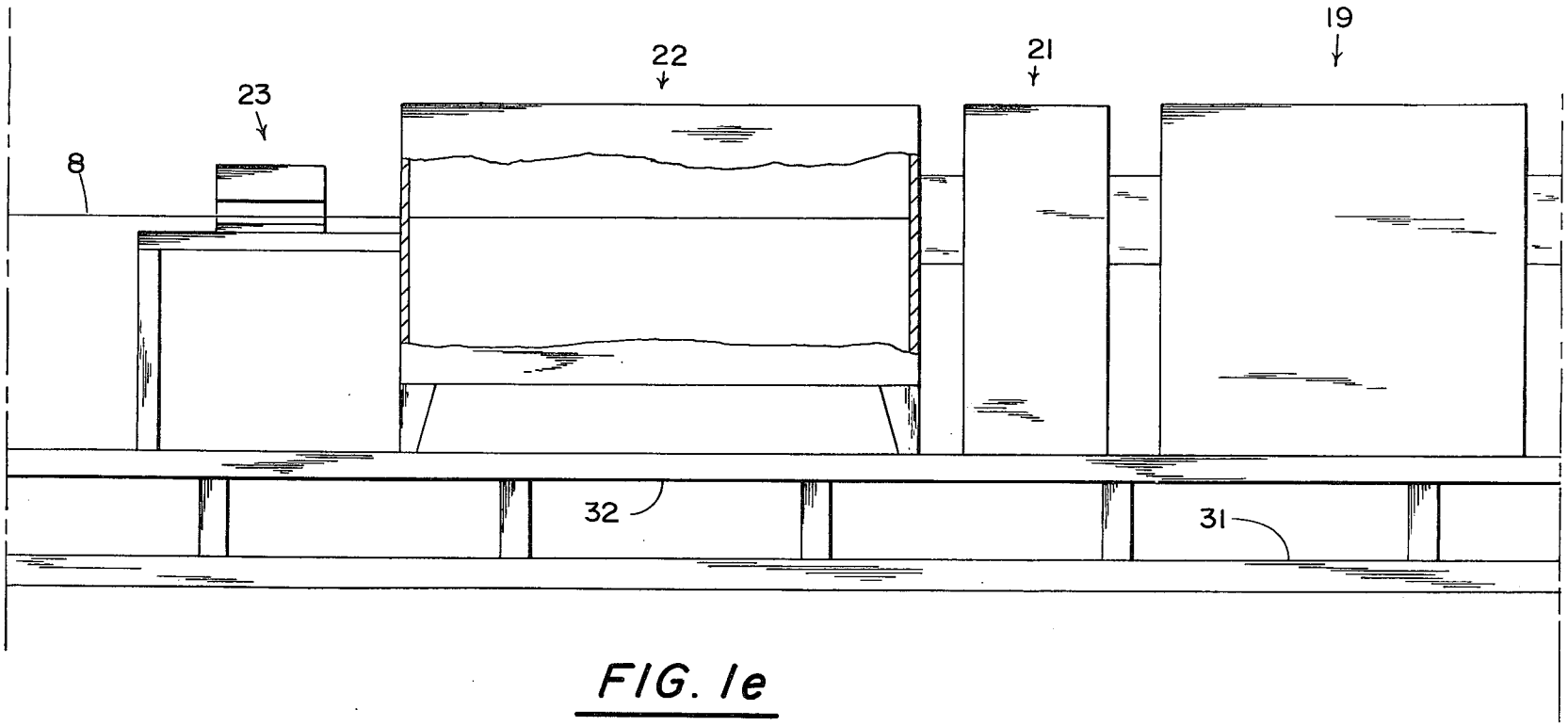

Referring to FIG. 1A, reference numberal 10 designates the first station in the system. Station 10 is the backing station which includes a turn-over stand 51 (not shown in detail) and a roll of protective film 9 for applying to moving metal web 8 which passes through backing station 10. The protective film is generally a polyester film about 0.001 inch thick or less or another suitable protective film which is sealed to the top side of the resist covered metal web 8. The covering of the metal web with a resist pattern is not part of the present invention; however, on each side of metal web 8, there is an etchant resist coating which has been exposed and developed to leave portions of the metal web unprotected. It is these portions of the metal web which are to be etched through to produce a set of openings which have a minimum dimension on the order of the thickness of the material. In order to arrive at an opening having a final dimension which is less than or on the order of the thickness of the material, it is necessary to define a resist pattern on top of the base material or metal web 8 similar to that shown in FIG. 2.

Figure 2:
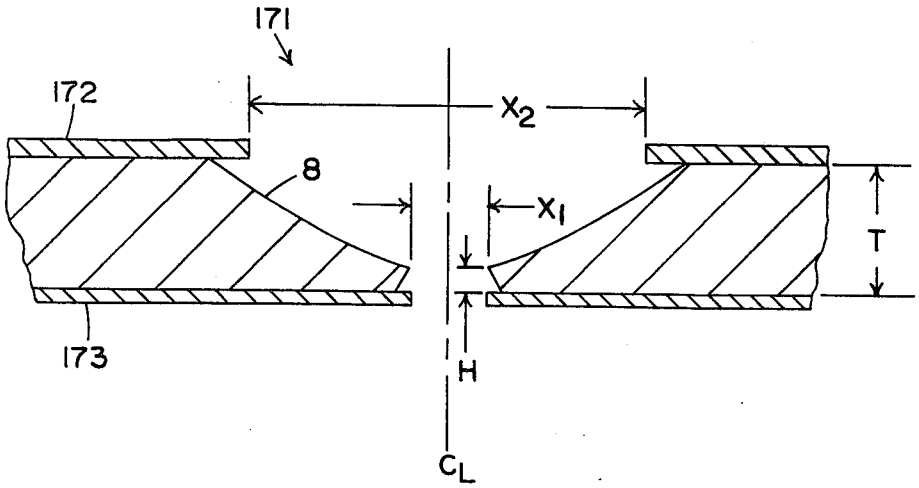
FIG. 2 is an enlarged cross section of an opening showing a typical resist pattern used with the present invention.

Referring to FIG. 2, reference numeral 171 designates an etched cross section of a single opening in a metal web having a thickness T. The etchant resist is located on both sides of the metal web 8 and is designated by reference numerals 172 and 173. Located behind resist layer 172, is an etched region which is substantially larger than the etched portion behind resist layer 173. The overall dimension of the opening defined in resist layer 172 is designated by $X_2$ and is substantially larger than the overall dimension of the opening defined by resist layer 173, which is designated by $X_1$. The dimension of the opening in the metal base material or web 8 is also denoted by $X_1$ and can be seen to be less than the web thickness T.

The present invention provides an apparatus and process to enable an operator to continuously manufacture a shadow mask having small, elongated holes from a continuous strip of flat metal material. A typical set of dimensions for a shadow mask would be a thickness T of 0.006 of an inch and an elongated slot having a width $X_1$ which may be as small as 0.002 inches or as large as 0.008 inches. In order to obtain these size openings, a resist pattern which defines openings is placed in register on opposite sides of web 8. Typically, the surface beneath resist layer 172 has an opening $X_2$ which is approximately 0.015 to 0.020 of an inch and is considerably larger than the opening $X_1$ defined by resist layer 173. In this particular embodiment, the length of the slot which is perpendicular to the plane of the drawing, may be 3 to 10 times the width $X_1$ of the slot.

During the etching in the various etching stations the side of web 8 covered by resist layer 173 is the top side and is completely covered by protective film 9 as web 8 passes through etching stations 11 and 12. The purpose of using a protective film for a shield on top of the resist layer 173 is to insure that no etchant fumes or etchant spray comes in contact with either the resist layer 173 or the surface beneath resist layer 173, as etchant fumes or etchant spatterings have been found to partially etch the surface of the web and thus have an adverse effect on the final dimensions and the shape of the openings of the mask.

Referring to FIG. 1A, one will note that when the under side of web 8 is spray etched by spray nozzles 82 which are located in etching stations 11 and 12, etchant spray is simultaneously directed vertically upward through a set of lower spray nozzles 82 and vertically downward through a set of upper spray nozzles 80. However, only the etchant spray from the lower nozzles comes in contact with web 8 as the upper surface of web 8 covered by film 9.

In general, the system comprises a number of metal webs or metal strip processing stations. Located down line from backing station 10 is an air duct 52 for introducing fresh air; however, the air duct is not a necessary part of the system. Located down line from air duct 52 are a series of etching and process handling stations which are all supported on a common support stand 32. A curb 31 runs co-extensive with the support stand. A first etching station 11 has a plurality of upper etchant spray nozzles 80 and lower etchant spray nozzles 82. The spray nozzles are fixedly mounted on a plenum chamber which typically is rotated through an angle of approximately 55° to allow the etchant spray from a single nozzle to be dispersed over a wide area.

First etching station 11 is followed by a second etching station 12 which is identical to etching station 11. Located down line from etching station 12 and before etching station 14 is a film wind up station 13. Located down line from etching station 14 are a further pair of etching stations 15 and 16 which perform the final etching operations, thus making a total of five separate etching stations which can spray an etchant such as ferric chloride on a steel web. Located down line from etching station 16 is a water rinse station 17 which is followed by a caustic rinse station 18. As the etched metal web 8 leaves the caustic rinse station 18, it enters a hot water rinse station 19 whereafter it passes through a cold water rinse station 21. After metal web 8 passes through the final water rinse station 12, web 8 is dried by radiant heaters located in a drying oven 22. Located down line from drying over 22 is a drive stand 24 that pulls web 8 through various processing stations, a cut-off station 25 that cuts the web and a cut mask transporting station 26 that transports the mask to a packaging station where the mask is packaged to be sent to the customer.

The stations in the system will now be described in more detail along with the relationship involved in accurately and continuously etching elongated openings in a metal web to provide a plurality of aperture masks.

Backing station 10 comprises the first part of the etching system which includes a turnover stand 51 (not shown in detail in the drawing). Turnover stand 51 includes a cylindrical hydrostatic member that hydrostatically supports and receives a resist covered metal web in a vertical plane and discharges the resist covered metal web 8 in a horizontal plane without damaging the protective resist layer. The resist covered metal web 8 passes around rollers 61, 62, 63 and 64 and then between a pair of pressure controllable rollers 65 and 66, that is the squeezing force generated between rollers 65 and 66 can be set at a predetermined level. In one embodiment, a roller is placed below the web and underneath the adhesive applicator.

Roller 62 is mounted on a pivot arm 101 which has a weight 101A located at the end opposite roller 62 to thereby provide a constant force on the web and thus control the slack of web 8 in backing station 10. Pressure control rollers 65 and 66 are connected to a magnetic brake (not shown) which maintains a constant resistance force or drag that prevents rotation of rollers 65 and 66 until the resistance is overcome. In the preferred embodiment, the magnetic brake comprises an electromagnet for maintaining a constant frictional torque during rotation of rollers 65 and 66.

A roll of protective film 9 is also located in station 10 and passes around a first roller 70, a second roller 71, a third roller 73 and between pressure rollers 65 and 66 where film 9 is pressed against the top of resist covered metal web 8. A hot melt adhesive gun 75 is located above web 8 to apply a strip of liquid adhesive to both edges of metal web 8 before web 8 and protective film 9 are brought into pressure contact between rollers 65 and 66. In the embodiment shown, the liquid adhesive is applied to web 8 immediately before web 8 and film 9 pass between rollers 65 and 66. However, th adhesive could also be applied to either the metal web or to film 9. In some instances, the film may contain an adhesive layer thereon which would eliminate the need for applying the adhesive during the start of the etching process.

After metal web 8 and film 9 are sealed together web 8 and film 9 pass under a large diameter roller 76 and enter first etching station 11 which is comprised of a set of upper oscillating spray nozzles 80 and an identical set of lower oscillating spray nozzles 82. The oscillating spray nozzles provide a fan spray of etchant to the bottom surface of metal web 8 and to the top surface of film 9.

Figure 1F:
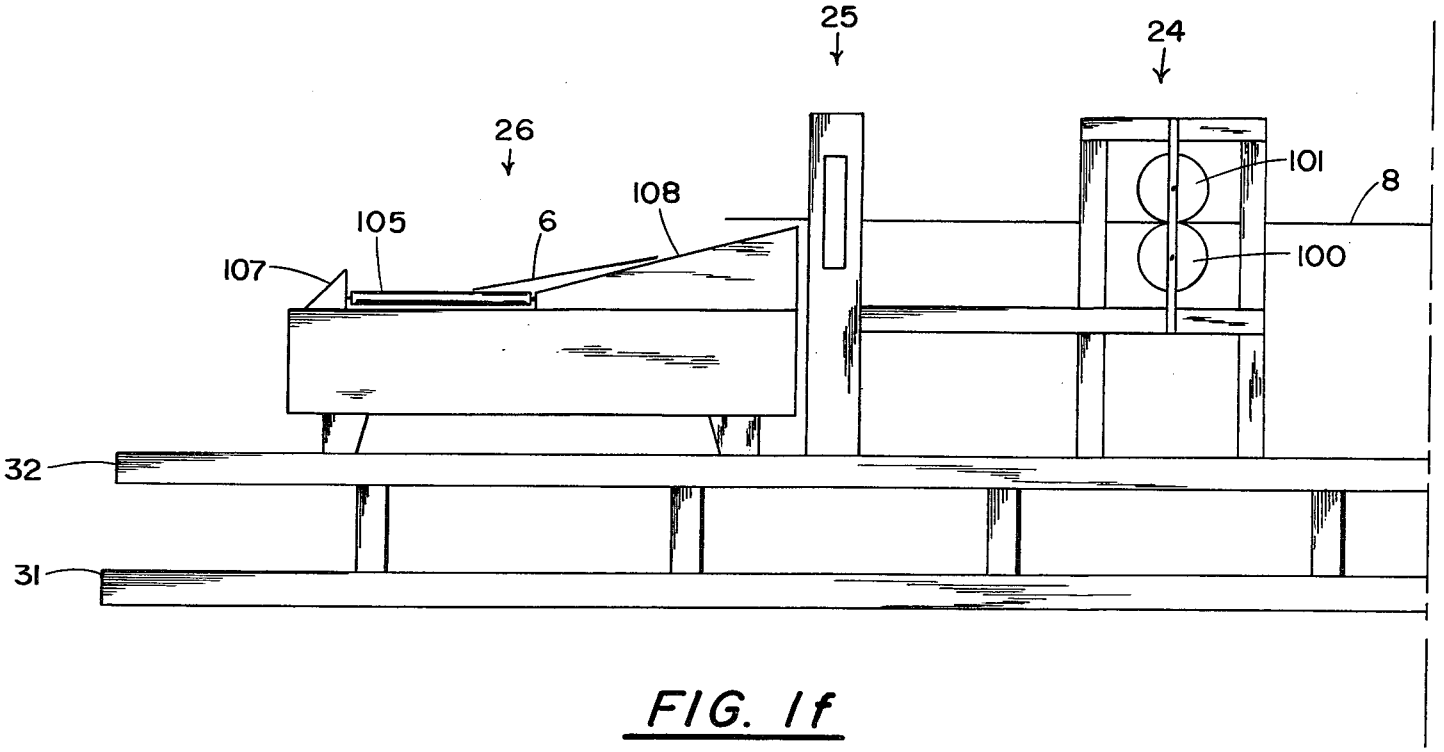

Typically, each of the top and bottom spray nozzles oscillate a total of approximately 55° to thereby spray etchant in an interlapping pattern over the entire surface area of web 8. A set of power rollers 81 which rotate counter clockwise are located in a spaced relationship in etching station 11 to support and assist in propelling web 8 through etching station 11. It should be noted that power rollers 81 rotate to propel web 8 through the system while rollers 65 and 66 produce a drag force that acts to prevent web 8 from being propelled through the system. However, the major pulling force on metal web 8 is the force from rollers 100 and 101 (FIG. 1F). With two forces pulling the web through the machine, it is necessary that the rate of rotation of drive rollers must be fairly closely matched to prevent scratching of the photoresist due to slipping.

An important functional feature which is taking place in etching station 11 is that while rollers 81 are propelling web 8 through etching station 11, the lower spray nozzles 82 are spraying etchant on the bottom side of web 8 while nozzles 80 are spraying etching on top of protective film 9. However, protective film 9 is both liquidproof and vapor proof to completely prevent any liquid etchant or etchant vapor from eroding or etching the top surface of web 8. The feature of spraying etchant on top of protective film 9 is a surprising departure from the conventional approach because it goes counter to the purpose of applying the protective film which is to prevent any etchant including etchant fumes from coming into contact with the exposed metal portions located in the top side of web 8. However, in spite of the necessity to keep etchant off the top side of web 8, etchant is sprayed on top of film 9 because it has been discovered that spraying etchant on both sides of the moving web prevents the web from irregular movements in etching stations 11 and 12 as well as from continually flexing due to the force of the etchant spray impinging against metal web 8. It is believed that the vertical movement of the web causes slight irregularities in the final etching of the small openings possibly through fracture of the resist or slight peeling of the resist in the area around the openings. Thus, to insure that the etching proceeds under the best possible conditions in the subsequent etching stations, it is preferred to hydrodynamically or hydrostatically suspend the web by creating a substantial balance of fluid forces on both sides of web 8 even though this procedure increases the risk of etchant penetration of protective film 9.

After passing through etching station 11, web 8 and film 9 enter a second etching station 12 which also has a series of oscillating upper spray nozzles 84 and a series of oscillating lower spray nozzles 85 which are identical to the series of spray nozzles located in etching station 11. Note, both etching station 11 and etching station 12 contain viewing doors 90 to allow an operator to visually inspect web 8 and protective film 9 as they pass through etching station 12. It is important to note that in etching station 12, etchant is also simultaneously sprayed on both the top of film 9 and the bottom of web 8. However, in station 12, as in station 11, only the bottom portion of web 8 is etched. Etching station 12 also contains a set of counter clockwise rotating power rollers for supporting and propelling web 8 and film 9 therethrough. Typically, the power rollers are spaced about 12 inches apart to support web 8 thereon.

After web 8 and film 9 leave etching station 12, web 8 and film 9 enter a third etching station 14. At this point, a rather large recess has been etched in the bottom side of metal web 8; however, the depth of the recess usually does not extend more than about 60% of the thickness of the metal web 8. In etching station 14, web 8 continues in its horizontal path while a protective film peeling mechanism 95 comprised of a first roller 96 and a second roller 97 strips protective film 9 from metal web 8. Protective film 9 passes around roller 97, under a third roller 98 to either powered takeup rolls 91 or 99. A pair of roller guides 92 and 93 are located in film unwinding station 13 for guiding film 9 onto either of takeup rolls 91 or 99. The purpose of having two takeup rolls is so that after one takeup roll is filled, the film can be wound onto the second takeup roll without having to stop the process.

Roller 96 which is mounted on pivotal arm 95 rolls on top of protective film 9 and prevents protective film 9 from deviating from its substantially horizontal course. Note, protective film 9 is peeled or stripped backward to reduce the amount of damage to the resist layer during the stripping process. However, in the preferred embodiment, the adhesive is only located in the margin areas of the web which do not contain any elongated apertures.

By placing the protective film stripping mechanism 95 within etching station 14, one can spray etchant on the top side of web 8 as soon as protective film 9 is removed. If film 9 were removed before web 8 entered etching station 14, it increases the risk of etchant splattering or etchant fumes forming irregular contact of the top surface of web 8 to cause non-uniform pre-etching of web 8. On a mass production system, pre-etching can reduce the yield of masks due to the masks having either improper sized openings or irregular shaped openings.

Two additional etching stations 15 and 16 which are identical to the etching stations 11, 12 and 14 are located downline from etching station 14 to complete the etching of metal web 8. The purpose of having five sets of etching stations with plurality of nozzles therein, is to diminish any effect from one nozzle as well as provide more precision control of the etching process. In practice, more or less etching stations could be used. However, it is preferred to have at least four sets of etching stations to obtain consistently good yields. In addition, film unwind station 13 could be placed further in etchant station 14 as well as at the beginning of etching station 14. Also, if more control of the etching process is desired, film unwind station 13 could be placed adjacent to other etching stations besides etching station 14.

After web 8 passes through the final etching station 16, web 8 enters a rinse station 17 which rinses the etchant solution from web 8 as quickly as possible in order to abruptly halt etching of web 8. That is, the etching process is abruptly stopped by a water rinse to prevent any over-etching of web 8. After web 8 is rinsed, web 8 passes into a caustic soda (sodium hydroxide) stripping station 18 which dissolves the resist coating on the top and bottom of web 8. After web 8 passes through caustic stripping station 18, web 8 enters a hot water rinse station 19 where the caustic soda solution is rinsed off. A second cold water rinse station 21 is located after rinse station 19 to complete the rinsing operation and insure that the mask is thoroughly clean. Preferably, rinse station 21 is a deionized water station to insure that the mask is clean of all foreign matter as it enters a drying station 22. Drying station 22 contains radiant heaters which are located above and below moving web 8.

At some point in the system, the size of the openings may be checked by a densitometer 23 in order to determine whether or not the openings are within tolerance. If the openings are too large, the operator can reduce the supply of etchant in etching stations 15 or 16. On the other hand, if the etching openings are too small or large, the operator may typically adjust the opening by adjusting the speed of the rollers. In some cases, the size of the openings will not be checked until after the masks have been cut into the proper shape and in this case, no densitometer would be installed in the system.

Metal web 8 continues on its path through a drive stand 24 which has assisted in pulling web 8 through the various etching stations. Drive stand 24 comprises a pair of powered drive rollers 100 and 101 which are held in pressure contact and rotated by a motor. Drive rollers assist in pulling web 8 through the various stations. The power rollers in each of the etching stations coact with drive rollers 100 and 101 to propel web 8 through the various stations in the system. In order to prevent web 8 from piling up as it is carried by the power rollers in the various stations, a continual braking force is applied by rollers 65 and 66. The actual brake may be mechanical, hydraulic or magnetic; however, in the present embodiment, a conventional magnetic brake which prevents rotation of rollers 65 and 66 until a predetermined force is reached. Typically, rollers 65 and 66 are set with sufficient braking force so that power rollers located in each of the etching stations could not propel web 8 through the various etching stations. Only when the drive stand rollers 100 and 101 are also engaged, can web 8 be transported through the various stations of the system.

In the final stations of the system, web 8 leaves drive stand 24 and enters a cutoff stand 25 which cuts off the portion of the web containing the pattern of apertures therein which is eventually formed into an aperture mask for insertion into a color television picture tube. The cut masks 6 then slide down a ramp 108 into mask transporting station 26 where a stop 107 prevents mask 6 from sliding past rollers 105. Rollers 105 are powered by a motor (not shown) and transport mask 6 to a mask packaging station (not shown) where the masks are packaged for delivery to the customer.

We claim:

1. The process of etching a continuous metal web to produce a plurality of openings therein comprising;

applying a first resist pattern on one side of a web and a second resist pattern on the opposite side of the web, the first resist pattern defining openings which have a minimum dimension less than the opening defined by the second resist pattern;

sealing a protective film on top of the first resist pattern;

propelling the web and protective film through an etching station;

simultaneously applying etchant on top of the protective film and to the second resist pattern;

removing the protective film located on top of the first resist pattern;

applying etchant to both sides of resist coated metal web to etch completely through the web to produce a plurality of openings.

2. The process of claim 1 wherein etchant is continuously sprayed on the metal web as the metal web passes through the etching station.

3. The process of claim 1 wherein the protective film is settled to the top of the first resist pattern by application of a liquid adhesive to the edge of the first resist pattern.

4. The process of claim 3 wherein the protective film is removed in an etching station.

5. The process of claim 4 wherein etchant is sprayed on the first resist pattern immediately after removal of the protective film.

6. An etching system for etching a continuous strip of resist coated metal web to produce an article having a plurality of openings having a minimum dimension on the order of the thickness of the material, comprising:

a first station for applying a film of protective material to one side of a continuously moving metal web;

first means for securing the film to one side of the continuously moving metal web;

further means for propelling the metal web and the protective film, said further means including a first set of drive rollers for propelling the metal web through said system, a second set of brake rollers for supplying a continual braking force to said metal web;

a first plurality of etching stations for receiving the resist covered metal web and protective film, said plurality of etching stations operable for supplying etchant to the resist covered metal web and the protective film wherein each of said plurality of etching stations includes spray nozzles for spraying etchant on opposite sides of the metal web;

a protective film removal station for removing the protective film from the resist covered metal web after the resist covered metal web and the protective film have passed through said first plurality of etch stations, said protective film removal station including means for removing the protective film and further means for preventing the metal web from being pulled from its plane of travel;

a second plurality of etching stations for supplying etchant to both sides of the resist covered metal web after the protective film has been removed; and said first plurality of etching stations located before said protective film removal stations and said second plurality of etching stations located after said protective film removal stations.

7. The invention of claim 6 wherein said etching system includes means for applying an adhesive.

8. The invention of claim 7 wherein said etching system includes means for cutting said web at predetermined intervals.

9. The invention of claim 8 wherein said means for removal of said protective film is located in one of the plurality of etching stations.

10. The invention of claim 9 wherein a pair of rollers are provided for securing said protective film to said metal web.

11. The invention of claim 10 wherein said etching system includes means for maintaining the metal web in a horizontal position during travel of the web through said apparatus.

12. The invention of claim 11 wherein the metal web is continuously supported throughout said apparatus by a plurality of rollers.

* * * * *

UNITED STATES PATENT OFFICE

CERTIFICATE OF CORRECTION

Patent No. 4,124,437 Dated November 7, 1978

Inventor(s) Herbert M. Bond, Charles E. Ring, John A. Edgar, Ronald Bennett, Willis K. Paul, Roland N. Harshbarger It is certified that error appears in the above-identified patent and that said Letters Patent are hereby corrected as shown below:

In claim 3, line 2, change "settled" to --sealed--

In claim 6, last line, change "stations" to --station--

Signed and Sealed this

*Thirteenth* Day of *February 1979*

[SEAL]

*Attest:*

RUTH C. MASON
*Attesting Officer*

DONALD W. BANNER
*Commissioner of Patents and Trademarks*